US005746527A

United States Patent [19]

Nebashi et al.

[11] Patent Number: 5,746,527

[45] Date of Patent: May 5, 1998

[54] PRINTING APPARATUS PROVIDED WITH AN AUTO CUTTER

[75] Inventors: Mitsuhiko Nebashi; Keiji Murakoshi; Satoshi Iwaya; Akihiro Goto, all of Suwa, Japan

[73] Assignee: Seiko Epson Corporation, Tokyo, Japan

[21] Appl. No.: 718,151

[22] Filed: Sep. 18, 1996

[30] Foreign Application Priority Data

Sep. 19, 1995 [JP] Japan ..... 7-240357

[51] Int. Cl.[6] ..... B41J 11/70

[52] U.S. Cl. ..... 400/621; 101/93.07; 346/24; 400/693

[58] Field of Search ..... 400/621, 693, 400/694; 101/93.07, 226, 227; 346/24

[56] References Cited

U.S. PATENT DOCUMENTS

| | | | |
|---|---|---|---|
| 2,780,288 | 2/1957 | Wharton et al. . | |
| 4,297,039 | 10/1981 | Lees | 400/120 |
| 4,451,167 | 5/1984 | Honma et al. | 400/621 |
| 4,663,638 | 5/1987 | Hirose | 346/136 |

FOREIGN PATENT DOCUMENTS

| | | |
|---|---|---|
| 0 068 406 | 1/1983 | European Pat. Off. . |
| 57-118852 | 6/1982 | Japan . |
| 4 185371 | 7/1992 | Japan . |

OTHER PUBLICATIONS

IBM Technical Disclosure Bulletin, vol. 26, No. 7A, Dec. 1983 "Paper Guillotine, Platen Guide And Feed Mechanism", C.N. Cooper; pp. 3333–3334, XP002021135.

*Primary Examiner*—Christopher A. Bennett

[57] ABSTRACT

A printing apparatus mainly comprises a first cover for, provided on a body frame including a print head 5, covering the print head 5; a second cover 39 for, disposed on the body frame opposing to the first cover by means of the transport path for transporting the recording medium 8, mounting an auto cutter 36. The auto cutter 36 comprises; a cutter frame 43 for fixing the auto cutter to the second cover 39; a cutter blade 26 for, movably supported on the cutter frame 43, cutting the recording medium 8 printed by the print head 5; and an auto cutter drive source 37 for, fixed on the cutter frame 43, driving the cutter blade 26 to cut the recording medium 8.

22 Claims, 6 Drawing Sheets

PRINTING APPARATUS PROVIDED WITH AN AUTO CUTTER

BACKGROUND OF THE INVENTION

1. Field of the Invention

The invention relates to a printer, and particularly to a printer provided with an auto-cutter which are typically used in cash registers, or the like.

2. Description of the Related Art

A printer provided with an auto cutter is discussed, for example Japanese Laid Open Utility Model No. 118852/82. In the printer of discussed therein, a head cover for protecting a print head is pivotally mounted on a base frame so that, when paper jamming occurs around the print head, the jammed paper can easily be removed by opening the head cover. Moreover, an auto cutter unit including a drive source is installed on the head cover.

In a conventional example in which an auto cutter unit including a drive source is installed on a head cover, the auto cutter is installed on the operator's side of the receipt paper discharge port, making it difficult to extract the receipt or visually check its print quality.

When the receipt discharge port is positioned in a high location matching the position of the auto cutter, the height of the overall printer increases, lengthening the distance the printed receipt paper must travel after printed and thus increasing both the time required for receipt issuance and the amount of wasted recording paper. Further, if journal printing mechanism is provided adjacent to the receipt printing mechanism, the receipt discharge port is placed protruding close to a writing platform used for correcting printing out results of the journal paper, thus hindering the correction operation.

Still further, since the auto cutter is a kind of a heat source, it is hindered to cool the print head by placing the auto cutter just above the print head, thus lowering the printing speed and causing poor printing quality.

OBJECTS OF THE INVENTION

Therefore, it is an object of the present invention to overcome the aforementioned problems.

It is another object of the present invention to provide a printer that offers superior legibility in printed receipts, that quickly issues receipts after printing, that wastes little recording paper, and that offers high speed and high quality printing.

SUMMARY OF THE INVENTION

In order to solve the above-mentioned problems, a printing apparatus according to the present invention is provided with a body frame including at least a printing element or means for printing on a recording medium and transport path for guiding to transport the recording media through the printing means, a platen disposed facing the printing means, an auto cutter for cutting the recording medium printed by the printing means. A first cover, provided on the body frame, covers the printing means. A second cover, disposed on the body frame opposing to the first cover by means of the transport path is, arranged to mount the auto cutter. The auto cutter comprises: a cutter frame for fixing the auto cutter to the second cover; a cutter blade for, movably supported on the cutter frame, cutting the recording medium printed by the printing means. An auto cutter drive source, fixed on the cutter frame, drives cutter blade to cut the recording medium.

According to the above-mentioned configuration, an auto cutter mechanism and its drive source are provided on the second cover that covers the platen opposing to the print head. Thus, it becomes easy to check the printing results on the recording medium and it is facilitated to cool the print head by removing the auto cutter, a kind of a heat source, from right above the print head.

Further, it is desirable that the second cover is movably mounted on the body frame. For example, the second cover is provided with a pair of pivots at an end portion thereof opposite the printing means and pivotally supported by the body frame at the pair of pivots, and the second cover is provided with a first recording medium guide for guiding one surface of the recording medium, the body frame is provided with a second recording medium guide for guiding the other surface of the recording medium, and wherein the first and second recording medium guides together form the transfer path for transferring the recording medium.

According to the above configuration, even if paper jamming has occurred in the vicinity of the printing head, it is easy to remove the jammed paper after moving to open the second cover.

In the above configuration, the printing apparatus may further comprise a printing mechanism for printing a second recording medium positioned in parallel to the first recording medium. The second cover is further provided with a support means for supporting, in a flat orientation at a specified angle, the opposing surface to the printed surface of the second recording medium to which printing has been applied, and the auto cutter drive source is positioned in space defined by the support means.

In accordance with the present invention, the auto cutter drive source is implemented as, for example, a motor and can be installed utilizing the space below the writing platform, thus eliminating space for mounting the motor around an outlet for the first recording medium to be cut by the auto cutter and facilitating the device size reduction.

Still further, it is also desirable that the printing apparatus further comprises a feed-out roller for, disposed for fractionally connected with the recording medium by means of tension force of the recording medium, feeding the recording medium into the transfer path. The pair of pivots of the second cover is supported at the lower position of the body frame than the feed-out roller. In order to realize this configuration, the first paper guide may comprise two parts one of which forming an inlet of the transfer path, and the one of the two parts may be provided on the second cover so as not to interfere the locus of the second cover.

According to the above-described configuration, the paper supply port which is an inlet for inserting the recording medium into the transfer path can be positioned in an upper area, namely nearer position to the operator. Consequently, paper can be inserted into paper supply port while visually checking the position of the inlet, significantly improving operability.

In the above configuration, it is desirable that the feed-out roller is driven through a transmission gear rotatably mounted on the body frame at an axis positioned roughly the same as the pair of pivots of the second cover.

According to the above-described configuration, since the transfer gear is positioned approximately at the center of the pivots of the second cover, the distance between the transfer gear and the feed-out roller rotatably fixed on the second cover does not change, thus maintaining a nearly constant meshing relationship between the two elements while the second cover pivots.

Other objects and attainments together with a fuller understanding of the invention will become apparent and appreciated by referring to the following description and claims taken in conjunction with the accompanying drawings.

BRIEF DESCRIPTION OF THE DRAWINGS

In the drawings wherein like reference symbols refer to like parts.

DESCRIPTION OF THE PREFERRED EMBODIMENTS

Figure 1:
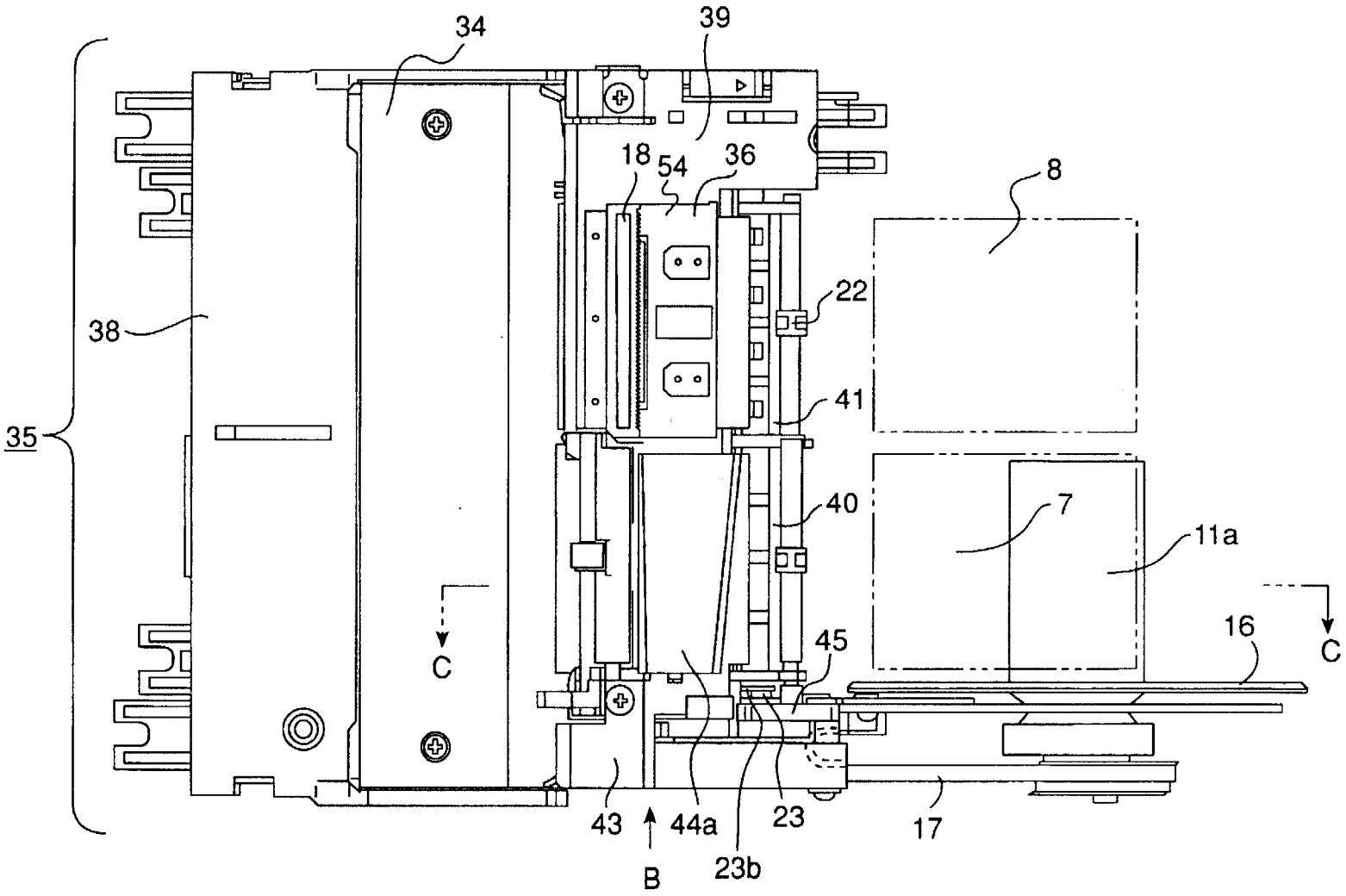
FIG. 1 is a top view of an embodiment of the printer in accordance with the present invention.
Figure 2:
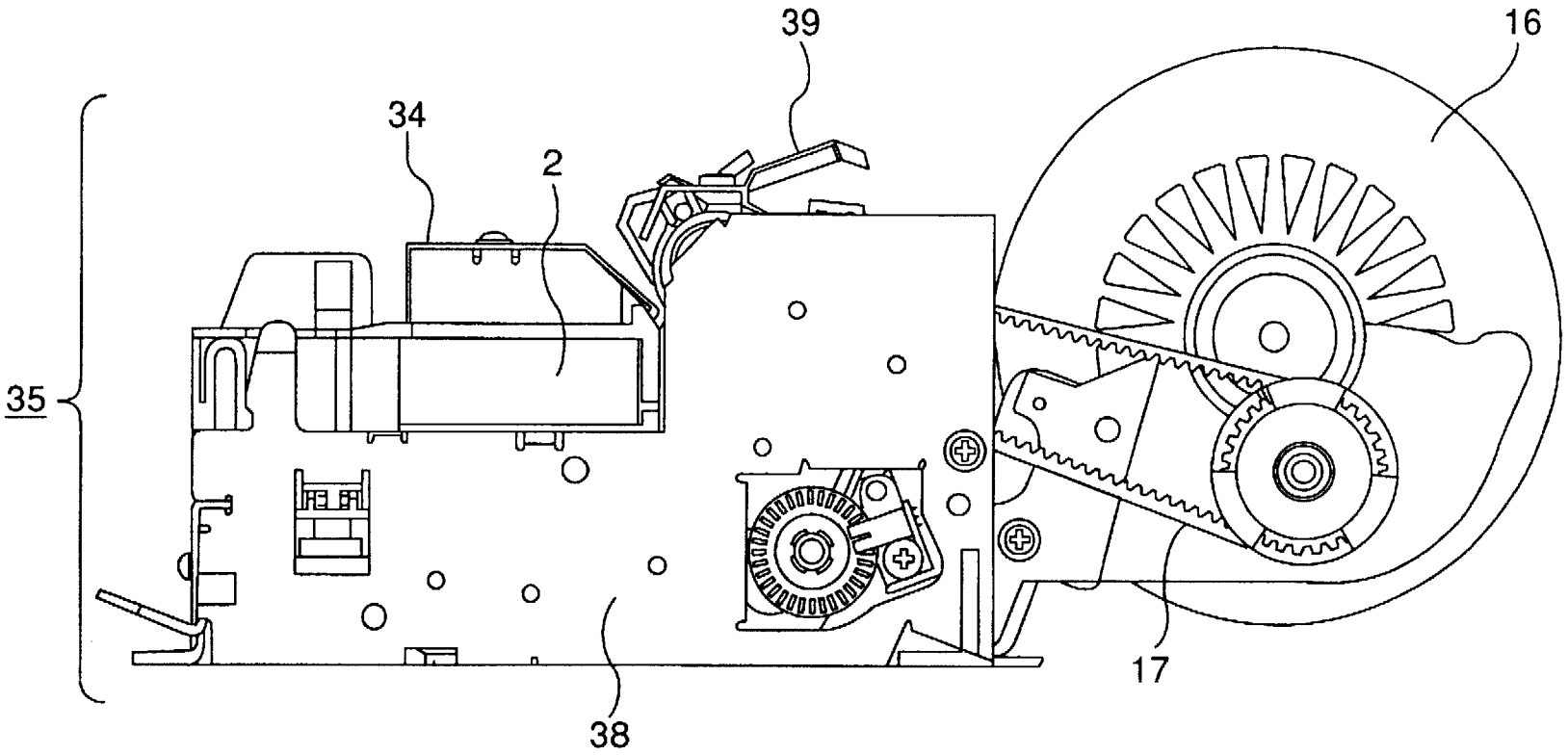
FIG. 2 is a side view when viewed from the direction of arrow B in FIG. 1.
Figure 3:
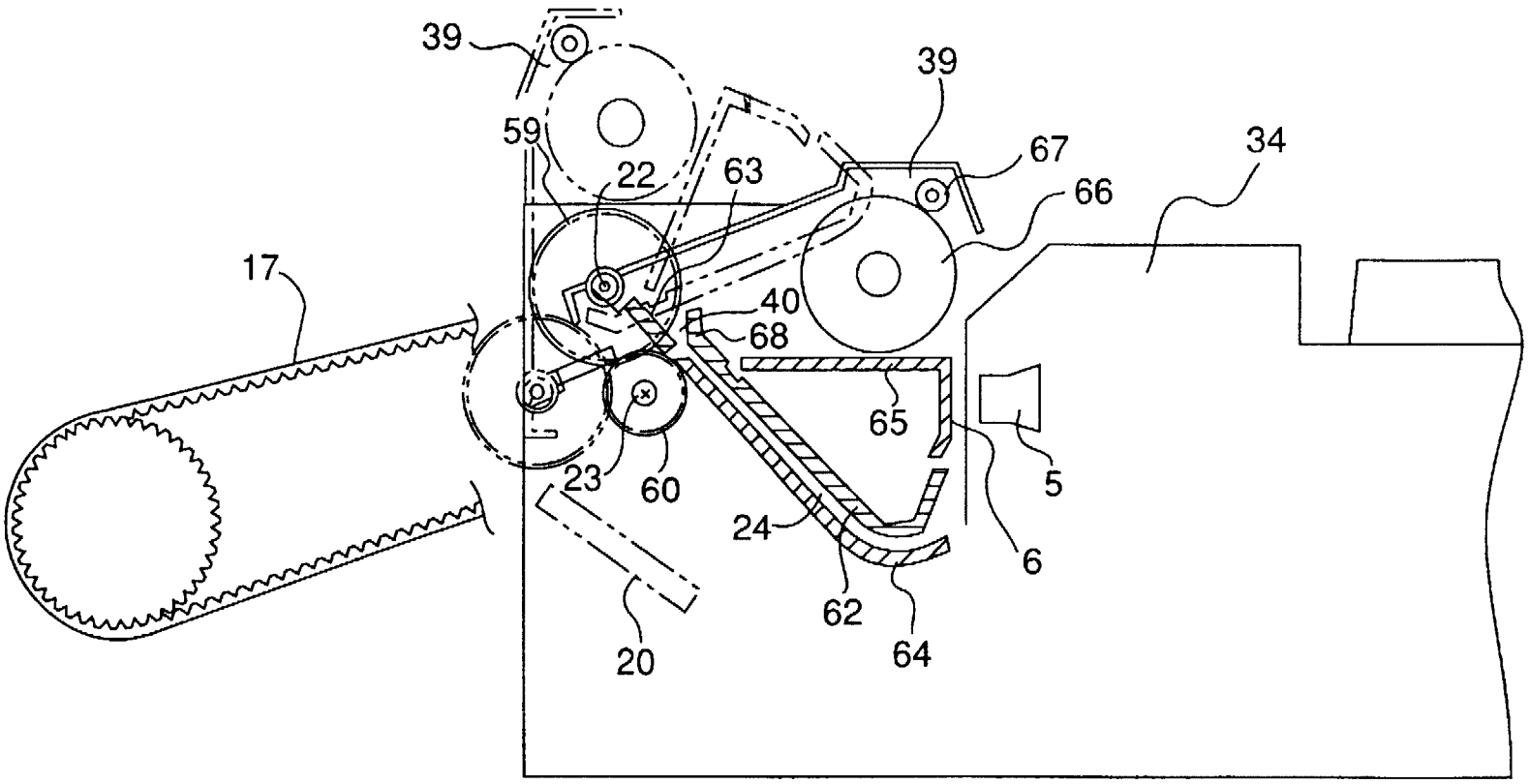
FIG. 3 is a cross-sectional view taken along line C—C in FIG. 1.
Figure 4:
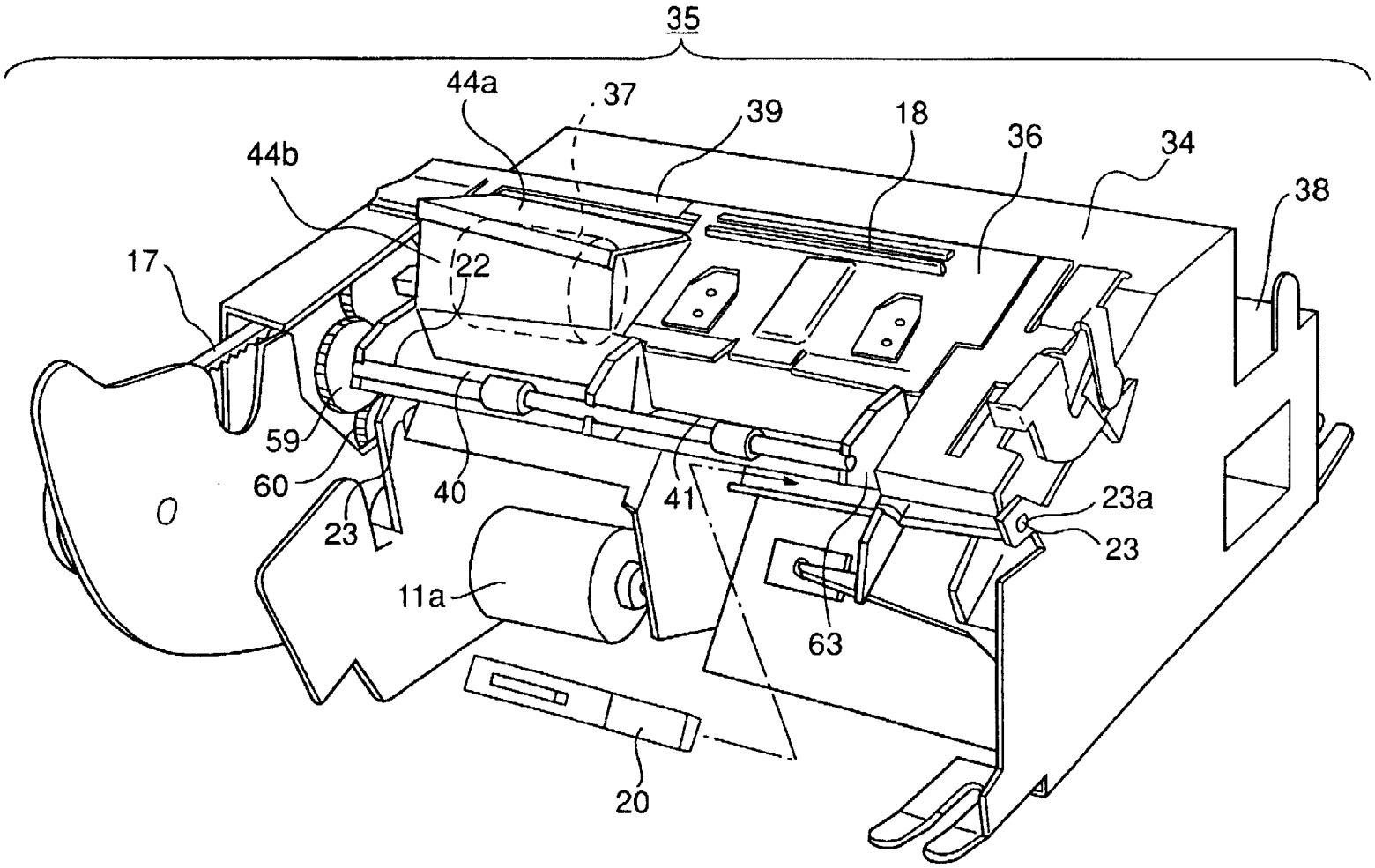
FIG. 4 is a rear perspective view of the embodiment shown in FIG. 1.
Figure 5:
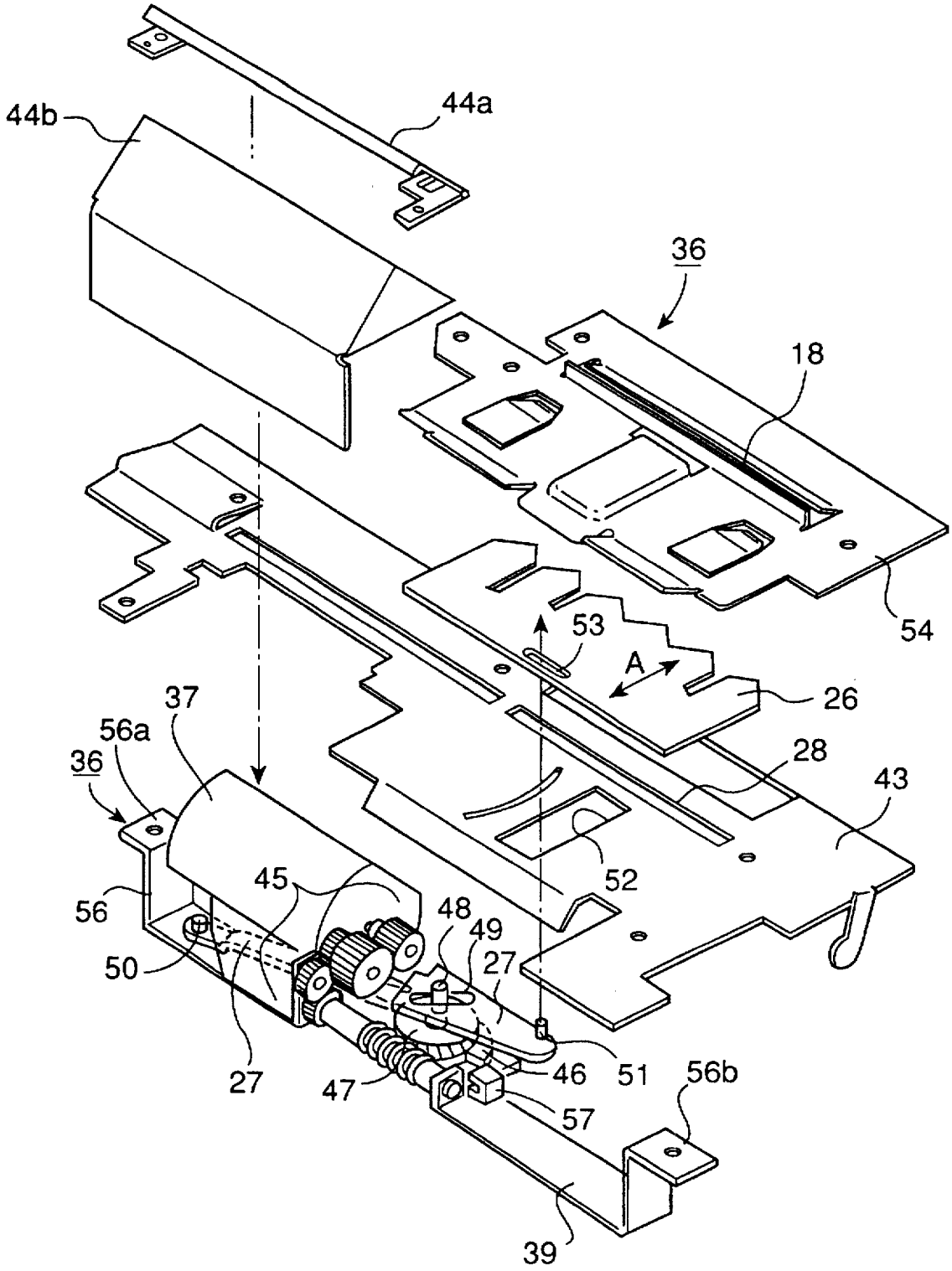
FIG. 5 is an exploded perspective view of the auto cutter mechanism provided in the printer of FIG. 1.
Figure 6:
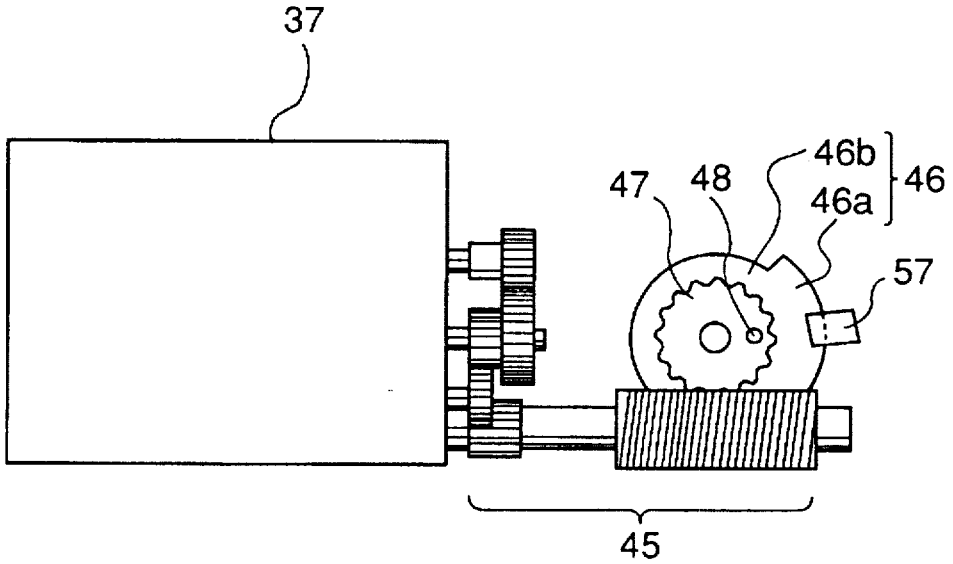
FIG. 6 is an enlarged view of the cutter drive source that drives the auto cutter mechanism.

Reference is now made to FIGS. 1 through 6 which show an embodiment of the printer in accordance with the present invention. FIG. 1 is the top view of printer 35 of example 1; FIG. 2 is a side view seen from the direction of arrow B of FIG. 1; FIG. 3 is a cross-sectional view taken along line C—C in FIG. 1; FIG. 4 is a rear perspective view of printer 35; FIG. 5 is an exploded perspective view of auto cutter mechanism 36 provided in printer 35; and FIG. 6 is an enlarged view of cutter drive source 37 that drives auto cutter mechanism 36.

Printer 35 of this embodiment is a dot impact printer to be embedded in cash registers, etc. Of course, as will be appreciated by one of ordinary skill in the art, other types of printers may be employed. As shown in FIGS. 1, 2, and 4, printer 35 comprises printer main unit 38, which includes cover portion 34, in which ribbon cassette 2 is detachably installed, and clamshell movable part 39 that is supported in a rotatable manner in the back of the upper area of printer main unit 38.

Printer 38 is provided with a printing mechanism (not shown in the figures) for reciprocally moving a carriage, on which print head 5 is mounted, back and forth in the width direction of recording papers 7 and 8; a paper-feeding mechanism (not shown in the figures) for feeding recording papers 7 and 8 to the printing position of print head 5; and drive motor 11*a* which is the common drive source for the printing mechanism and paper-feeding mechanism.

Referring to FIG. 3, clamshell movable part 39 comprises platen 65, a paper-feeding mechanism consisting of paper feed roller 66 and paper pressing roller 67 for pressing recording paper onto paper feed roller 66, auto cutter mechanism 36 (FIG. 1) for cutting receipt paper 8 installed in the upper area of the paper-feeding mechanism, and upper paper guide 62 formed out of, for example, a resin or other suitable material, wherein upper paper guide 62 mounts the remaining elements listed above. Note that auto cutter mechanism 36 is configured as a unit to be easily detached when provided as an option to this printer.

A protrusion (not shown in the figures) is formed on upper paper guide 62, and engages with hole 23*a* (FIG. 4) provided in the frame of printer 38; these protrusions serve as pivot shafts 23, and pivots of movable part 39 configured by engaging these protrusions with the holes, respectively. A stopper area (not shown in the figures) is also formed on upper paper guide 62, and engages with the claw area (not shown in the figures) provided in a rotatable manner in the printer main unit. Upper paper guide 62 is normally fastened in its regular position by the claw area, and is rotated around pivot shaft 23 which is a support area of printer main unit 38 by disengaging the claw area from the stopper area.

As shown in FIG. 3, clamshell movable part 39 is installed in a rotatable manner in an upper rear position of printer main unit 38, to allow the exposure of paper route 24 formed by upper paper guide 62 and lower paper guide 64 both of which extend from paper supply ports 40 and 41 on the back of the printer to the printing position. In FIG. 3, the solid lines indicate the state in which clamshell movable part 39 is closed; the two-dot-chain lines indicate a state in which clamshell movable part 39 is opened.

Recording paper 7 to be supplied to paper port 40 is journal paper which is saved by stores for managing sales and inventory. As shown in FIGS. 1 and 2, journal paper 7 that has been printed continually passes through the upper area of clamshell movable part 39 and is taken up by take-up reel 16 installed in the back of printer main unit 38. Take-up reel 16 is rotated by take-up belt 17 which is operatively connected to the paper-feeding mechanism inside printer main unit 38.

The recording paper to be supplied to paper supply port 41 is receipt paper 8 (FIG. 1) to be handed to customers, and after printing, is sent to receipt discharge port 18 provided on the top of clamshell movable part 39.

As shown in FIG. 4, stamp set 20 for imprinting a store name, etc. is detachably mounted below paper supply port 41 into which the receipt paper 8 is supplied. Note that since FIG. 3 is a cross-section taken along C—C in FIG. 1, it does not show stamp set 20. However, in order to show the insertion direction of stamp set 20 and its position inside the printer main unit, the position of stamp set 20 viewed from the direction of arrow B in FIG. 1 is indicated by two-dot-chain lines in FIG. 3.

As shown in FIGS. 1 and 3, paper supply ports 40 and 41 are provided side by side in the back of clamshell movable part 39. Feed-out roller 22 for feeding out journal paper 7 and receipt paper 8 are provided in the paper supply ports 40 and 41. As shown in FIG. 3, this feed-out roller 22 is provided in a position that is elevated a specified height above pivot shaft 23 of clamshell movable part 39, i.e., a position that is toward the upper edge of the back of clamshell movable part 39.

Feed-out roller 22 is always turning when the printer is active, and when the paper is made taut by the drive force generated by the paper feed roller during the feeding of journal paper 7 and receipt paper 8, a frictional force is generated between feed-out roller 22 and the paper, thus feeding the paper out. This reduces the paper feeding load caused by the inertial mass of the paper roll, etc.

In more detailed terms, roller axis drive gear 59 is provided on the feed-out roller 22 on the side of clamshell movable part 39, and is mounted in a rotatable manner on part 63 of upper paper guide 62, which forms paper supply ports 40 and 41. In this embodiment, one of protrusions which serve as pivot shafts 23 is provided on an end of an arm member 23*b* which can be easily vent upward in FIG. 1 to retract the protrusion from engaging position. And, arm member 23*b* is formed integrally with upper paper guide 63.

Therefore, movable part 39 can be detached or removed from printer main unit 38 by vending arm member 23b so that the protrusion 23 is disengaged from hole 23a. Transmission gear 60, which rotates feed-out roller 22 by engaging with roller axis drive gear 59, is supported on the same shaft as pivot shaft 23 of clamshell movable part 39, on the side of printer main unit 38. Because of this configuration, roller axis drive gear 59 on the side of clamshell movable part 39 does not disengage from transmission gear 60 on the side of printer main unit 38 even when clamshell movable part 39 is opened.

The rotational axis of transmission gear 60 may use the central rotational axis of clamshell movable part 39 as in this embodiment, or could be another component located on the extended line of the central rotational axis. It is also possible to position the central axis of transmission gear 60 and the rotational center axis of the clamshell movable part slightly away from each other so that the distance between the central axis of roller axis drive gear 59 and the central axis of transmission gear 60 increases within a range that does not cause the two gears to disengage from each other when clamshell movable part 39 is opened.

Note that stamp set 20 is positioned immediately below paper route 24 which guides the recording paper fed out by feed-out roller 22.

As shown in FIGS. 5 and 6, auto cutter mechanism 36 for cutting continuous receipt paper 8 and auto cutter drive source 37 for driving auto cutter mechanism 36 are provided inside clamshell movable part 39.

As shown in FIGS. 5 and 6, auto cutter mechanism 36 moves movable blade 26, which cuts receipt paper 8 in cooperation with fixed blade 28, back and forth in the direction (direction of arrow A in FIG. 5) perpendicular to the face of receipt paper 8, by means of crank-shaped rocking lever 27.

Auto cutter drive source 37 which drives auto cutter mechanism 36, for example, is a high-torque type motor, and as shown in FIG. 4, is positioned below writing platform 44a used for correcting journal print and provided in cutter frame 43 of clamshell movable part 39, and is covered by motor cover 44b for the sake of safety operation.

When the printer is placed horizontally, it is desirable to move the journal paper perpendicularly to the viewpoint of the operator, such as a store clerk, who must check the print result of the journal paper, etc. Therefore, to achieve such a state, writing platform 44a is formed by bending a thin metal plate so as to define a predetermined angle with, for example, a desk surface and thus defines a room under the writing platform. In this embodiment, the space below the writing platform 44a is used for housing the DC motor which is cutter drive source 37. It is also possible to form the writing platform as a part of cutter frame 43.

Referring to FIG. 6 the output axis of cutter drive source 37 drives worn gear 47, which is formed in one piece with cam plate 46, via gear train 45. Drive pin 48 is embedded in gear 47; and drive pin 48 is engaged with guide hole 49 formed on rocking lever 27 and rocks rocking lever 27 around rocking center axis 50 as gear 47 moves (FIG. 5).

Protruding pin 51 provided on the tip of rocking lever 27 goes through guide hole 52 provided in cutter frame 43 and is fitted into engagement groove 53 of movable blade 26 which is overlaid on cutter frame 43 in a slidable manner. The rocking motions of rocking lever 27 move movable blade 26 back and forth via pin 51.

Plate-shaped upper cover 54 which covers movable blade 26 is provided on cutter frame 43. Therefore, movable blade 26 slides inside the gap between cutter frame 43 and upper cover 54 according to the movements of rocking lever 27.

Support frame 56, which supports rocking center axis 50 of rocking lever 27 while allowing free rotation, forms the operation space for gear train 45 and rocking lever 27 when top edges 56a and 56b of the side walls provided on both sides are fastened to cutter frame 43.

The rotation of cam plate 46, integrated with gear 47 which drives rocking lever 27, is detected by position sensor 57 having a pair of arms, one of which is provided with a light emitting element the other with a light receiving element, defining light beam path therebetween, the arms being placed so that the light beam is interrupted by cam plate 46. The movements of cutter drive source 37 is controlled in accordance with the output of the position sensor 57 as described below.

Cam plate 46 comprises two parts having different diameters. Reference numeral 46a in FIG. 6 denotes a part having a larger diameter, 46b a smaller diameter. A reference position of cam plate 46 is defined as the rotational position where a transition from part 46b to 46a is detected by position sensor 57 while cam plate 46 rotates a predetermined direction. And, a partial cut position of cam plate 46, where receipt paper is partially cut allowing an operator to cut it manually afterwards, is defined as the rotational position where a transition to part 46b from 46a is detected while cam plate 46 is further rotated in the same direction.

When the power is supplied to the device or the device is initialized, drive source 37, implemented as a DC motor, is driven to make cam plate 46 rotate to the reference position. Thus movable blade 26 is set at a standby position. When the partial cut is required, firstly cam plate 46 is rotated to the partial cut position from the reference position by DC motor 37, then DC motor 37 is reversed to return cam plate 46 to the reference position. In a full cut operation, cam plate 46 is fully rotated by DC motor 37 from the reference position to the reference position in accordance with position sensor 57.

Next, upper paper guide 62 will be described in detail. As shown in FIG. 3, part 63 of upper paper guide 62, which is positioned near paper supply ports 40 and 41, acts as a lower paper guide for guiding the bottom side of the recording paper. This configuration prevents paper supply port formation area 68 of upper paper guide 62 from interfering with the lower paper guide when clamshell movable part 39 rotates around pivot shaft 23. That is, since part of the lower paper guide located within the rotational trace of paper supply port formation area 68 is equivalent to part 63 of the upper paper guide in the present embodiment, this area is separated from the lower paper guide and is allowed to rotate with the upper paper guide. In this way, clamshell movable part 39 can be rotated to any desired angle.

In above-described printer 35, auto cutter mechanism 36 which requires a large drive torque is driven by dedicated drive source 37 installed in clamshell movable part 39. This allows the drive motor installed in printer main unit 38 to be a small, low-torque motor of which the drive target is limited to the printing mechanism and the paper-feeding mechanism, both of which require relatively small drive torque. Consequently, the specification of the drive motor to be installed in printer main unit 38 can be optimized, achieving reductions of both production cost and device size.

Furthermore, even if a paper jam occurs inside auto cutter mechanism 36 of clamshell movable part 39, it is possible to open clamshell movable part 39 and to move the movable blade of the cutter to remove the clearly visible jammed paper, because dedicated cutter drive source 37 is installed inside clamshell movable part 39. This results in easy problem correction and superior maintainability.

Additionally, the space below writing platform 44*a* for correcting journal print was conventionally not used at all. Therefore, by locating cutter drive source 37 below writing platform 44*a*, the space below the writing platform 44*a* can be efficiently used and it is possible to prevent the installation of cutter drive source 37 from increasing the size of clamshell movable part 39.

In the above described embodiment of the present invention, auto cutter mechanism 36 is provided with both movable blade 26 and fixed blade 28 on cutter frame 43. However, the present invention is not limited to such a configuration but applicable for a auto cutter mechanism having a fixed blade separated from the cutter frame and fixed to the body frame which does not move when the clamshell movable frame moves to open the transport path. By utilizing this configuration, it becomes easier to set a paper roll with the clamshell movable frame opened because it can be eliminated to put the paper through an opening of cutter frame defining a fixed blade.

Further, feed-out roller 22 and its axis may be positioned below pivot shaft 23 of the clamshell movable part, in order to prevent feed-out roller 22 and its axis from interfering with the clamshell movable part when it is opened. Furthermore, stamp set 20 for imprinting a store name, etc. may be positioned immediately below path 24 through which paper fed out by feed-out roller 22 passes. However, in such a configuration, paper supply ports 40 and 41 to be positioned in the back of the printer, and the stamp set insertion position are located well below the clamshell movable part. This makes visual observation difficult when inserting paper into paper supply ports 40 and 41 or when supplying ink to stamp set 20, resulting in poor operability.

In the present embodiment, paper supply ports 40 and 41 in the back of the printer are installed in the back of clamshell movable part 39; and feed-out roller 22, which feeds out recording journal papers 7 and 8 inserted into paper supply ports 40 and 41 toward print head 5, is positioned above pivot shaft 23 of clamshell movable part 39; as a result, paper supply ports 40 and 41 and the mounting position of stamp set 20 can be located in a relatively high position in the back of the printer. Therefore, paper can be inserted into paper supply ports 40 and 41 or ink can be supplied to stamp set 20 while visually observing these processes from the front of the printer, resulting in improved operability.

Furthermore, moving up the position of feed-out roller 22 has increased the paper take-up range of feed-out roller axis 22, and as a result, the rotational torque transmitted to feed-out roller axis 22 can be transmitted to recording papers 7 and 8 with decreased loss.

As described in detail above, in the printer of the present invention, even if a paper jam occurs inside the auto cutter mechanism of the clamshell movable part, it is possible to open the clamshell movable part and to move the movable blade of the cutter to remove the clearly visible jammed paper because the dedicated cutter drive source is installed inside the clamshell movable part. This results in easy problem correction and superior maintainability.

Additionally, the space below the writing platform for correcting journal print was conventionally not used at all. Therefore, by locating the cutter drive source below the writing platform, the space below writing platform can be efficiently used and it is possible to prevent the installation of the cutter drive source from increasing the size of the clamshell movable part.

While the invention has been described in conjunction with several specific embodiments, it is evident to those skilled in the art that many further alternatives, modifications and variations will be apparent in light of the foregoing description. Thus, the invention described herein is intended to embrace all such alternatives, modifications, applications and variations as may fall within the spirit and scope of the appended claims.

Reference Numerals

5 Print head
7, 8 Recording media
17 Take-up belt
20 Stamp set
22 Feed-out roller
24 Path
26 Movable blade
27 Rocking lever
36 Auto cutter mechanism
37 Cutter drive source
38 Printer main unit
39 Clamshell movable part
40, 41 Paper supply ports
43 Cover
44 Writing platform
45 Gear train
46 Cam plate
54 Upper cover
60 Transmission gear
62 Upper paper guide
64 Lower paper guide

What is claimed is:

1. A printing apparatus comprising:

a body frame including at least a printing element for printing on a first recording medium, having a first surface and a second surface, and transport path for guiding the first recording medium through said printing element, an auto cutter for cutting the first recording medium printed by said printing element, and a first cover, provided on said body frame, for covering said printing element, wherein, when the recording medium is guided by said transport path adjacent said printing element, the first surface faces said auto cutter and the second surface faces said first cover; and a second cover, disposed on said body frame opposing said first cover, for mounting said auto cutter, said auto cutter comprising:

a cutter frame for fixing said auto cutter to said second cover;

a cutter blade, movably supported on the cutter frame, for cutting the first recording medium; and an auto cutter drive source for driving said cutter blade to cut the first recording medium.

2. A printing apparatus according to claim 1, wherein said second cover is movably mounted on said body frame.

3. A printing apparatus according to claim 2, wherein said second cover comprises:

a pair of pivots at an end portion thereof opposite said printing element and pivotally supported by said body frame at said pair of pivots;

a first recording medium guide for guiding the first surface of the first recording medium, wherein said body frame comprises a second recording medium guide for guiding the second surface of the first recording medium, and wherein said first and second recording medium guides together form said transport path.

4. A printing apparatus according to claim 1, further comprising a printing mechanism for printing on a second recording medium positioned in parallel to the first recording medium, wherein said second cover further comprises a support means having a flat rigid surface for supporting said second recording medium from the back allowing writing on the printed surface of said second recording medium, and wherein said auto cutter drive source is positioned in a space defined by said support means.

5. A printing apparatus according to claim 1, wherein the second surface of said first recording medium faces said printing element.

6. A printing apparatus according to claim 1, wherein said second cover comprises:

at least one pivot at an end portion thereof opposite said printing element and pivotally supported by said body frame at said at least one pivot;

a first recording medium guide for guiding the first surface of the first recording medium, wherein said body frame comprises a second recording medium guide for guiding the second surface of the first recording medium, and wherein said first and second recording medium guides together form said transport path.

7. A printing apparatus according to claim 6, further comprising a feed-out roller in frictional contact with the first recording medium for feeding the first recording medium into said transport path, wherein said at least one pivot of said second cover is supported at a position of said body frame lower than said feed-out roller.

8. A printer according to claim 7, wherein said first paper guide comprises a first portion forming an inlet of said transport path, and a second portion provided on said second cover so as not to interfere with movement of said second cover.

9. A printer according to claim 7, wherein the second cover further comprises a third recording medium guide for forming an inlet of said transport path and for guiding the second surface of said first recording medium in cooperation with said second recording medium guide.

10. A printing apparatus according to claim 7, further comprising a transmission gear rotatably mounted on said body frame at an axis positioned approximately the same as said at least one pivot of said second cover, wherein said feed-out roller is driven by said transmission gear.

11. A printing apparatus comprising:

a body frame including at least a printing element for printing on a first recording medium and transport path for guiding the first recording medium through said printing element, an auto cutter for cutting the first recording medium printed by said printing element, and a first cover, provided on said body frame, for covering said printing element; and a second cover, disposed on said body frame opposing said first cover, for mounting said auto cutter, said auto cutter comprising:

a cutter frame for fixing said auto cutter to said second cover;

a cutter blade, movably supported on the cutter frame, for cutting the first recording medium; and an auto cutter drive source for driving said cutter blade to cut the first recording medium, wherein said second cover is movably mounted on said body frame, said second cover comprising:

a pair of pivots at an end portion thereof opposite said printing element and pivotally supported by said body frame at said pair of pivots;

a first recording medium guide for guiding a first surface of the first recording medium, wherein said body frame comprises a second recording medium guide for guiding a second surface of the first recording medium, and wherein said first and second recording medium guides together form said transport path, said printing apparatus further comprising a feed-out roller in frictional contact with the first recording medium for feeding the first recording medium into said transport path, wherein said pair of pivots of said second cover is supported at a position of said body frame lower than said feed-out roller.

12. A printer according to claim 11, wherein said first paper guide comprises a first portion forming an inlet of said transport path, and a second portion provided on said second cover so as not to interfere with movement of said second cover.

13. A printer according to claim 11, wherein the second cover further comprises a third recording medium guide for forming an inlet of said transport path and for guiding said second surface of said first recording medium in cooperation with said second recording medium guide.

14. A printing apparatus according to claim 11, further comprising a transmission gear rotatably mounted on said body frame at an axis positioned approximately the same as said pair of pivots of said second cover, wherein said feed-out roller is driven by said transmission gear.

15. A printing apparatus comprising:

a body frame including at least a printing element for printing on a first recording medium, having a first surface and a second surface, and transport path for guiding the first recording medium through said printing element, an auto cutter for cutting the first recording medium printed by said printing element, and a first cover, provided on said body frame, for covering said printing element, wherein, when the recording medium is guided by said transport path adjacent said printing element, the first surface faces said auto cutter and the second surface faces said printing element; and a second cover, disposed on said body frame opposing said first cover, for mounting said auto cutter, said auto cutter comprising:

a cutter frame for fixing said auto cutter to said second cover;

a cutter blade, movably supported on the cutter frame, for cutting the first recording medium; and an auto cutter drive source for driving said cutter blade to cut the first recording medium.

16. A printing apparatus according to claim 15, wherein said second cover is movably mounted on said body frame.

17. A printing apparatus according to claim 16, wherein said second cover comprises:

at least one pivot at an end portion thereof opposite said printing element and pivotally supported by said body frame at said at least one pivot;

a first recording medium guide for guiding the first surface of the first recording medium, wherein said body frame comprises a second recording medium guide for guiding the second surface of the first recording medium, and wherein said first and second recording medium guides together form said transport path.

18. A printing apparatus according to claim 15, further comprising a printing mechanism for printing on a second recording medium positioned in parallel to the first recording medium, wherein said second cover further comprises a support means having a flat rigid surface for supporting said second recording medium from the back allowing writing on the printed surface of said second recording medium, and wherein said auto cutter drive source is positioned in a space defined by said support means.

19. A printing apparatus according to claim 17, further comprising a feed-out roller in frictional contact with the first recording medium for feeding the first recording medium into said transport path, wherein said at least one pivot of said second cover is supported at a position of said body frame lower than said feed-out roller.

20. A printer according to claim 19, wherein said first paper guide comprises a first portion forming an inlet of said transport path, and a second portion provided on said second cover so as not to interfere with movement of said second cover.

21. A printer according to claim 19, wherein the second cover further comprises a third recording medium guide for forming an inlet of said transport path and for guiding the second surface of said first recording medium in cooperation with said second recording medium guide.

22. A printing apparatus according to claim 19, further comprising a transmission gear rotatably mounted on said body frame at an axis positioned approximately the same as said pair of pivots of said second cover, wherein said feed-out roller is driven by said transmission gear.

* * * * *